United States Patent [19]

Andreasson

[11] Patent Number: 4,597,373

[45] Date of Patent: Jul. 1, 1986

[54] IGNITION SYSTEM WITH SAFETY CIRCUIT

[75] Inventor: Bo C. Andreasson, Göteborg, Sweden

[73] Assignee: Aktiebolaget Electrolux, Stockholm, Sweden

[21] Appl. No.: 679,378

[22] Filed: Dec. 7, 1984

[30] Foreign Application Priority Data

Dec. 20, 1983 [SE] Sweden ..... 8307031

[51] Int. Cl.[4] ..... F02P 5/145; F02P 11/00

[52] U.S. Cl. ..... 123/630; 123/149 C; 123/417

[58] Field of Search ..... 123/416, 417, 479, 630, 123/149 C, 149 D

[56] References Cited

U.S. PATENT DOCUMENTS 4,378,769 4/1983 Haubner et al. ..... 123/421 X 4,515,118 5/1985 Haubner et al. ..... 123/417 X

*Primary Examiner*—Tony M. Argenbright

*Attorney, Agent, or Firm*—Alfred E. Miller

[57] ABSTRACT

A system for the automatic recommencing of the ignition function of an i.c. engine with a computer controlled ignition system. The system includes an oscillator which occasionally can stop working. An RC-circuit is charged by ignition pulses supplied by the microcomputer and is discharged by possible failure of these pulses. A sensing circuit influenced by the RC-circuit thereby supplies a reset pulse to the computer which then recommences the supply of ignition pulses.

4 Claims, 3 Drawing Figures

IGNITION SYSTEM WITH SAFETY CIRCUIT

This invention relates to a safety circuit in a computerized ignition system for i.c. engines comprising a micro-computer, for use, for example, in ignition advance control.

Ignition systems for i.c. engines are subjected to great stress in the form of transient voltages induced by spark discharges in the system. Some parts of the system must therefore be protected or alotted an extra function which eliminates the risk of sudden failure of the system. An example of such a sensitive portion is the oscillator of the system which feeds the circuits in the computer and therefore is indispensable. A failure in the operation of the oscillator will usually stop the engine if the system is not provided with a safety arrangement against such an interruption.

In accordance with the present invention a safety circuit is provided which, in the event of ceasing or slowly repeated ignition pulses from the computer, emits a restarting signal (reset pulse) to the computer so that it is set on initial values of the ignition procedure which is intended to be effected by the system, and the oscillator thereby receives a start pulse. The initial values effect the release of an ignition pulse from the computer at a predetermined point on a curve of a primary winding voltage induced in an ignition coil. Due to the safety circuit the computer recommences the automatic emittance of ignition pulses and the engine is kept running during the disturbance which assumably has occurred.

An embodiment of a safety circuit according to the invention is described in the following with reference to the accompanying drawings.

Figure 1:
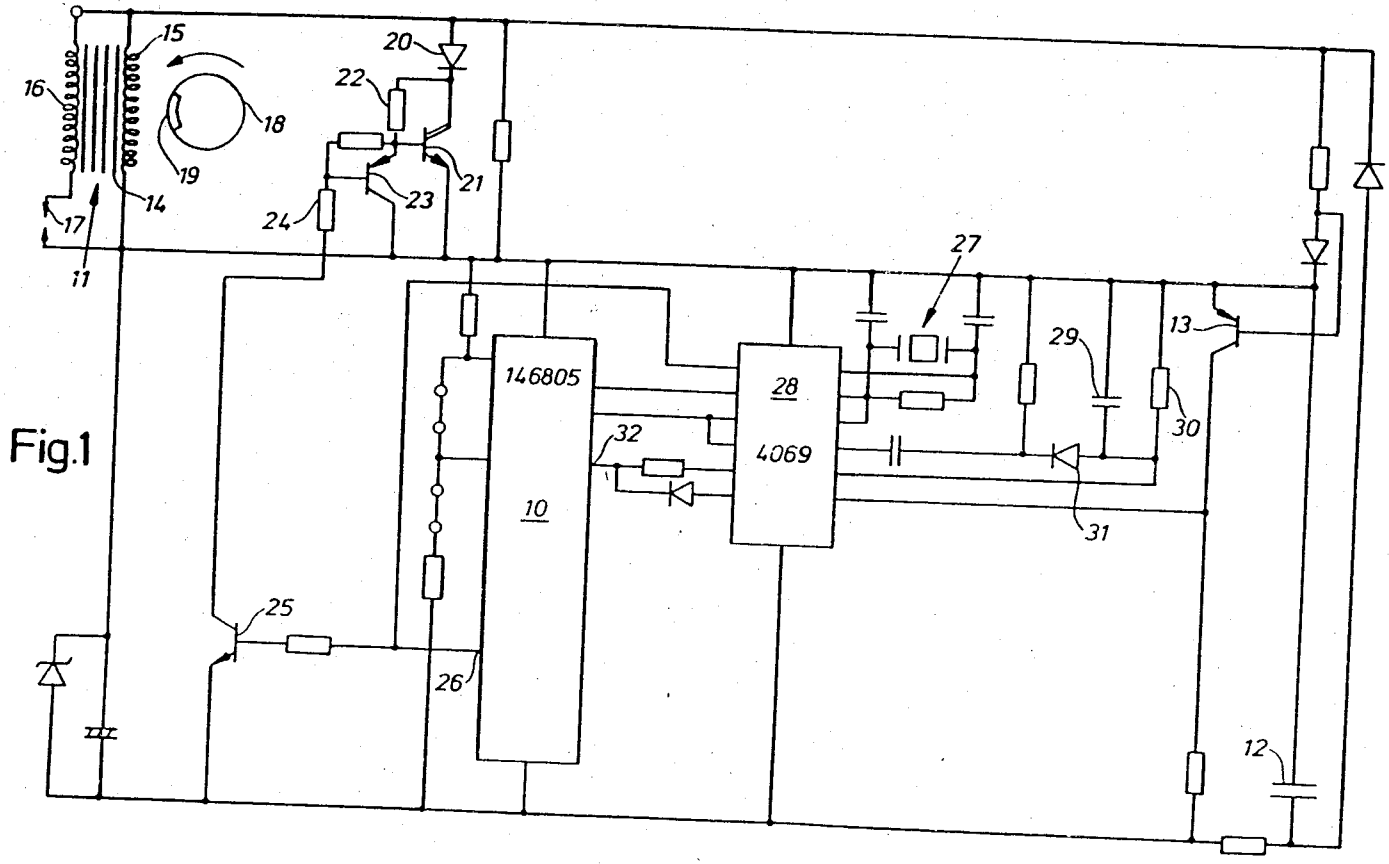
Figure 2:
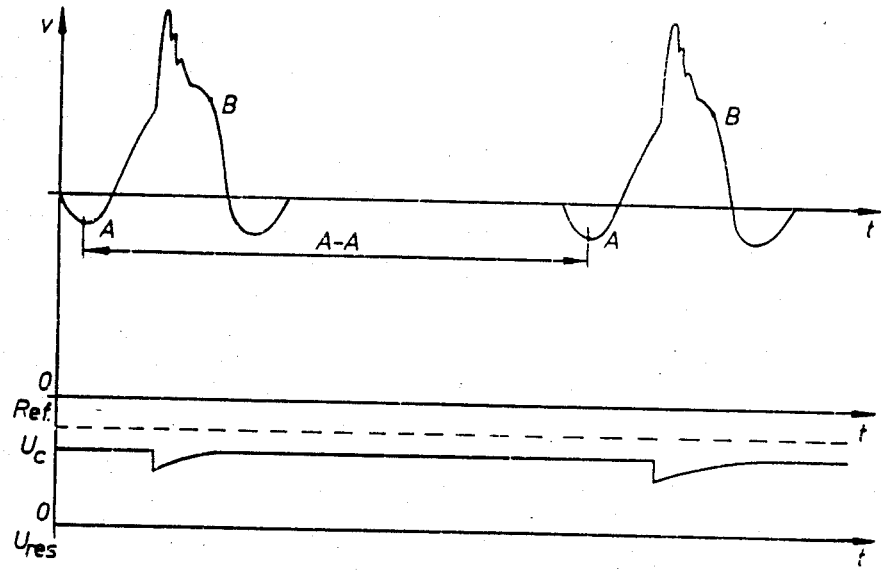
Figure 3:
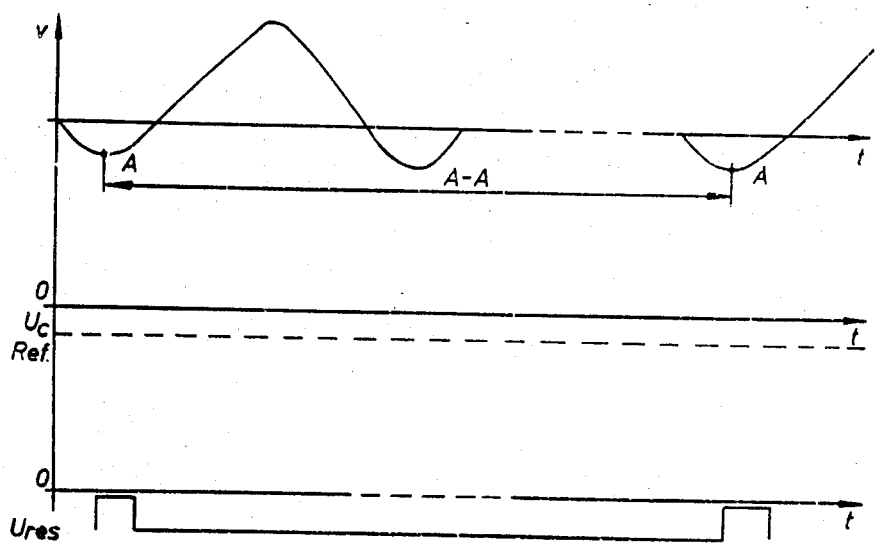

FIG. 1 shows a wiring diagram of an ignition system,

FIG. 2 signal curves in the ignition system,

FIG. 3 modified signal curves in the system.

A wiring diagram of the whole ignition system is shown in FIG. 1 including a micro-computer 10 with the notation MC 146805. The current supply to the computer and the surrounding circuits is derived from the negative half-waves of the primary winding voltage (FIG. 2) of an ignition generator 11 which keeps a capacitor 12 charged to the circuit operating voltage. A transistor amplifier 13 is provided for feeding a pulse at the time of a reference point A on the voltage curve. This pulse is a start signal of the ignition procedure. The ignition coil has an iron core 14 with windings 15, 16 of which the latter supplies a high voltage and the release of a spark in a spark plug 17. The iron core is positioned close to the flywheel 18 of the engine provided with a magnet 19 to induce the voltage in the winding 15.

The components of the ignition energy circuit are those usually provided in a transistor ignition system. A diode 20 passes positive pulses from the winding 15 through a Darlington transistor 21 which gets a control current through a resistor 22. The primary winding voltage causes a current through the circuit, whereby a magnetic field is produced in the core 14. Another transistor 23 is initially non-conductive because its base-resistor 24 does not yet pass a control current. This resistor is connected to an output 26 on the computer which supplies a trigger pulse at the ignition time for the engine, via transistor 25 whereby the transistor 23 starts conducting and the base current of the transistor 21 ceases. The transistor 21 breaks the primary winding current to cause a sudden decrease of the magnetic field to thereby induce an ignition voltage in the winding 16. An ignition procedure takes place as described below in broad outline.

The input of the computer to which the signal from the amplifier 13 is supplied is scanned by the micro-computer and the time A is stored as a reference time. The storing is possible since the micro-computer has a timer running at a fixed frequency. At every reference time the number of timer pulses occuring since the preceding reference time is registered. The number of pulses corresponds to 360° rotation of the crankshaft. By dividing the number of pulses between the reference times A—A by a predetermined number, e.g. 16, a number of pulses remains which corresponds to an ignition advance of 360/16=22.5°. This number is called the reference number and is a memory data stored in a static memory of the computer for use in determining the ignition time. The reference number can be a function of the r.p.m. (e.g. the reference stored for use at low r.p.m. can be inversely proportional to r.p.m.). When the number of timer pulses reaches the said reference number the ignition is initiated via the output 26 of the computer. The timer is set to zero every time the reference time passes and the counting to the reference number takes place for every spark. At low r.p.m. the ignition occurs at the point B on the curve in FIG. 2, since the ignition advance is then constant, a condition known by the expression that the ignition has a "phase-locking" on the voltage curve. At high r.p.m. the reference number is dependent on the r.p.m. The number of timer pulses between A—A directly (or indirectly) forms an address to a position in the memory of the computer where the reference number corresponding to the ignition advance is stored.

The micro-computer can use a built-in or alternatively an externally disposed oscillator and in the present case an external oscillator 27 is used. It is connected via CMOS inverter 28 of type 4069. In the introduction it was mentioned that the oscillator is indispensable and therefore must run without interruption. The circuit for maintaining this running is shown at the side of the oscillator. It is comprising of a capacitor 29, a resistor 30 and a diode 31. There is a "reset" input 32 on the computer and to this input signals from the circuit are forwarded via the inverter 28, which breaks the connection when the voltage across the same falls below a reference value, e.g. half the operating voltage in the circuit. This property is used for indication of the charge of the capacitor 29. In normal duty at a medium r.p.m. (FIG. 2) the pulses $U_0$ of the primary winding voltage appear rather closely on the time axis and at every pulse the capacitor 29 is charged to full voltage ($U_c$) through the diode 31. Between the chargings $U_c$ falls a little because of the current through the resistor 30, but not enough for the inverter 28 to supply a reset pulse on the input 32, since the voltage $U_{res}$ is constant.

Upon a disturbance in the ignition system the r.p.m. of the engine falls very quickly and the engine stops if the ignition function is not recovered. During slow running, e.g. 100 r.p.m., the pulses of the primary winding voltage appear sparsely on the time axis (FIG. 3) and the voltage $U_c$ has time to fall far below half the operating voltage in the reset circuit. As long as $U_c$ is above this value $U_{res}$ is constant, but when $U_c$ falls below this half value $U_{res}$ approaches 0 which results in a voltage pulse on the input 32 at the output of the inverter 28, because signals are inverted in the inverter. A reset pulse to the computer resets it quickly to initial values for starting another ignition procedure and starting the oscillator. When the next primary winding voltage appears another ignition spark is released and another charging gives a capacitor voltage $U_c$, whereby the reset pulse ceases. When the r.p.m. of the engine increases these reset pulses disappear, since the pulses of the primary winding voltage are now more frequency (FIG. 2). The circuit will, of course, emit a reset pulse also when the engine is started from standstill since the voltage $U_c$ is then 0.

The description relates to a preferred embodiment of the invention which, however, can be varied within the scope of the following claims. On the drawing notations are given for a micro-computer used as an example and a likewise suitable inverter.

I claim:

1. In an ignition system for an i.c. engine with a magnetic system for generating ignition energy, an ignition coil, a spark plug connected to the secondary winding of the coil, the primary winding of the coil being connected to an ignition switch switchable by triggering, a detector connected to establish a reference time for every spark, a micro-computer with a static memory, a timer, an oscillator, a comparator in which timer pulses and a reference code from the timer and memory respectively are brought into coincidence in order to supply a trigger pulse via output circuits to the said ignition switch, and a reset input on said micro-computer for receiving reset pulses from a pulse generator, the improvement wherein the pulse generator comprises an RC-circuit connected to be chargeable by said output circuits of the micro-computer and to discharge between the trigger pulses to a residual voltage in dependence of the r.p.m. of the engine, and further comprising a sensing circuit coupled between the RC-circuit and said reset input for generating said reset pulse proceeding from a residual voltage which falls below a predetermined reference value for the residual voltage.

2. An ignition system according to claim 1, wherein the sensing circuit is comprised of an inverter.

3. An ignition system according to claim 1, wherein said output circuits of the computer are kept conducting for charging the RC-circuit provided that trigger pulses are supplied from the computer.

4. An ignition system according to claim 3, wherein the output circuits are periodically conductive making one conductive period by every trigger pulse.

* * * * *